US007195458B2

(12) United States Patent
Liang

(10) Patent No.: US 7,195,458 B2
(45) Date of Patent: Mar. 27, 2007

(54) IMPINGEMENT COOLING SYSTEM FOR A TURBINE BLADE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 219 days.

(21) Appl. No.: 10/884,440

(22) Filed: Jul. 2, 2004

(65) Prior Publication Data

US 2006/0002795 A1 Jan. 5, 2006

(51) Int. Cl.
*F01D 5/18* (2006.01)

(52) U.S. Cl. ..... 416/97 R

(58) Field of Classification Search ..... 415/115–116; 416/96 R, 96 A, 97 R
See application file for complete search history.

(56) References Cited

U.S. PATENT DOCUMENTS 4,063,851 A 12/1977 Weldon
4,183,716 A 1/1980 Takahara et al.
4,257,737 A * 3/1981 Andress et al. ..... 416/97 R
4,312,624 A 1/1982 Steinbauer, Jr. et al.
5,090,866 A 2/1992 Blair
5,100,293 A 3/1992 Anzai et al.
5,259,730 A 11/1993 Damlis et al.
5,271,715 A * 12/1993 Zelesky et al. ..... 416/97 R
5,356,265 A 10/1994 Kercher
5,486,093 A * 1/1996 Auxier et al. ..... 416/97 R
5,577,884 A 11/1996 Mari
5,688,104 A * 11/1997 Beabout ..... 415/115
5,902,093 A * 5/1999 Liotta et al. ..... 416/97 R
5,931,638 A 8/1999 Krause et al.
5,975,851 A * 11/1999 Liang ..... 416/97 R
6,183,198 B1 2/2001 Manning et al.
6,402,471 B1 6/2002 Demers et al.
6,431,832 B1 8/2002 Glezer et al.
6,709,230 B2 3/2004 Morrison et al.
7,014,424 B2 * 3/2006 Cunha et al. ..... 416/97 R

FOREIGN PATENT DOCUMENTS

GB 2202907 A * 10/1988 ..... 416/96 R

* cited by examiner

*Primary Examiner*—Christopher Verdier

(57) ABSTRACT

A turbine blade for a turbine engine having a leading edge cooling system formed from a suction side cooling channel and a pressure side cooling channel. Cooling fluids flow into the leading edge cooling channels through impingement orifices that meter cooling fluid flow. The cooling fluids may form vortices in the cooling channels before being released from the turbine blade through gill holes. The cooling fluids then form a boundary layer of film cooling fluids on an outer surface of the turbine blade.

17 Claims, 4 Drawing Sheets

IMPINGEMENT COOLING SYSTEM FOR A TURBINE BLADE

FIELD OF THE INVENTION

This invention is directed generally to turbine blades, and more particularly to hollow turbine blades having internal cooling channels for passing cooling fluids, such as air, through the cooling channels to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion and a platform at one end and an elongated portion forming a blade that extends outwardly from the platform. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Conventional turbine blades often include a plurality of holes in the leading edges that form showerheads for exhausting cooling fluids from the internal cooling systems to be used as film cooling fluids on the outer surfaces of the turbine blades. Often times, the cooling fluids flowing through these holes are not regulated. Instead, cooling fluids are often passed through the showerhead at too high of a flow rate, which create turbulence in boundary layers of cooling fluids at the outer surfaces of the turbine blades. This turbulence reduces the effectiveness of downstream film cooling. In addition, the cooling fluids are often discharged at dissimilar pressures, which further reduces the downstream film cooling effectiveness. While these conventional systems reduce the temperature of leading edges of turbine blades, a need exist for an improved leading edge cooling system capable of operating more efficiently.

SUMMARY OF THE INVENTION

This invention relates to a turbine blade cooling system of a turbine engine. In particular, the cooling system includes a multiple channel leading edge cooling system for removing heat from the leading edge of a turbine blade. The turbine blade may be generally elongated and have a leading edge, a trailing edge, a tip at a first end, a root coupled to the blade at an end opposite the first end for coupling the blade to the disc, and at least one cavity forming at least a portion of the cooling system. The cooling system may be formed from a leading edge cooling channel formed from a pressure side cooling channel extending radially within the elongated blade and a suction side cooling channel extending radially within the elongated blade and separated from the pressure side cooling channel by a rib. The pressure side cooling channel may include at least one impingement orifice providing a fluid pathway between the pressure side cooling channel and other portions of the cooling system. In addition, the suction side cooling channel may include at least one impingement orifice providing a fluid pathway between the suction side cooling channel and other portions of the cooling system. The impingement orifices may be offset within the cooling channels such that cooling fluids are directed to flow generally along the rib separating the suction side and pressure side cooling channels to form vortices in the cooling channels. The impingement orifices may include filleted inlets and filleted outlets as well.

In at least one embodiment, the leading edge cooling channel may be formed from a plurality of cooling channels that regulate the flow of cooling fluids through the cooling system. For instance, there may be, but is not limited to, about three pressure side cooling channels and about five suction side cooling channels. The cooling channels may be offset from each other in the spanwise direction to increase convection in the channels. In other embodiments, the suction side and pressure side cooling channels may be aligned in the spanwise direction.

The cooling system may also include one or more gill holes in the outer wall providing a fluid pathway between the suction side cooling channel and an outer surface of the turbine blade. The gill holes may be located in the suction side cooling channel or the pressure side cooling channel, or both. The gill holes may be positioned in the cooling channels such that cooling fluids exhausted through the gill holes are not directed directly into oncoming combustion gases. Rather, the gill holes may be positioned in the outer wall such that cooling fluids exhausted from the gill holes are directed generally downstream with the flow of combustion gases.

In operation, cooling fluids, which may be air and other gases, are passed into the cooling system through the root of a blade from a compressor or other source. At least a portion of the cooling fluids flow through the impingement orifices into the leading edge cooling channels. For instance, the cooling fluids may flow through the impingement orifices and form vortices in the cooling channels. As the cooling fluids spin within the cooling channels and contact the walls forming the cooling channels, the cooling fluids increase in temperature. The cooling fluids are exhausted from the cooling channels through the gill holes. Because of the angle of the gill holes, the cooling fluids exhausted by the gill holes are not dispersed into the main flow of combustion gases. Rather, the cooling fluids form a layer of film cooling fluids at an outer surface of the turbine blade.

An advantage of this invention is that the impingement orifices meter the flow of cooling fluids that enter the leading edge cooling channel, thereby controlling the temperature of the leading edge.

Another advantage of this invention is that the impingement orifices limit the flow of cooling fluids from the gill holes and thereby limit cooling fluid penetration into the flow of combustion gases, yielding a desirable coolant sub-boundary layer at the outer surface of the turbine blade.

Yet another advantage of this invention is that the position of the impingement holes create vortices in the suction side and pressure side cooling channels that increase convection in these areas and increase heat removal from the outer wall proximate to the stagnation region.

Another advantage of this invention is that the compartmentalized leading edge cooling channel maximizes usage of the cooling fluid for a particular turbine blade inlet gas temperature and pressure profile.

Still another advantage of this invention is that by offsetting the pressure side cooling channels relative to the suction side cooling channels the amount of heat reduction is increased.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
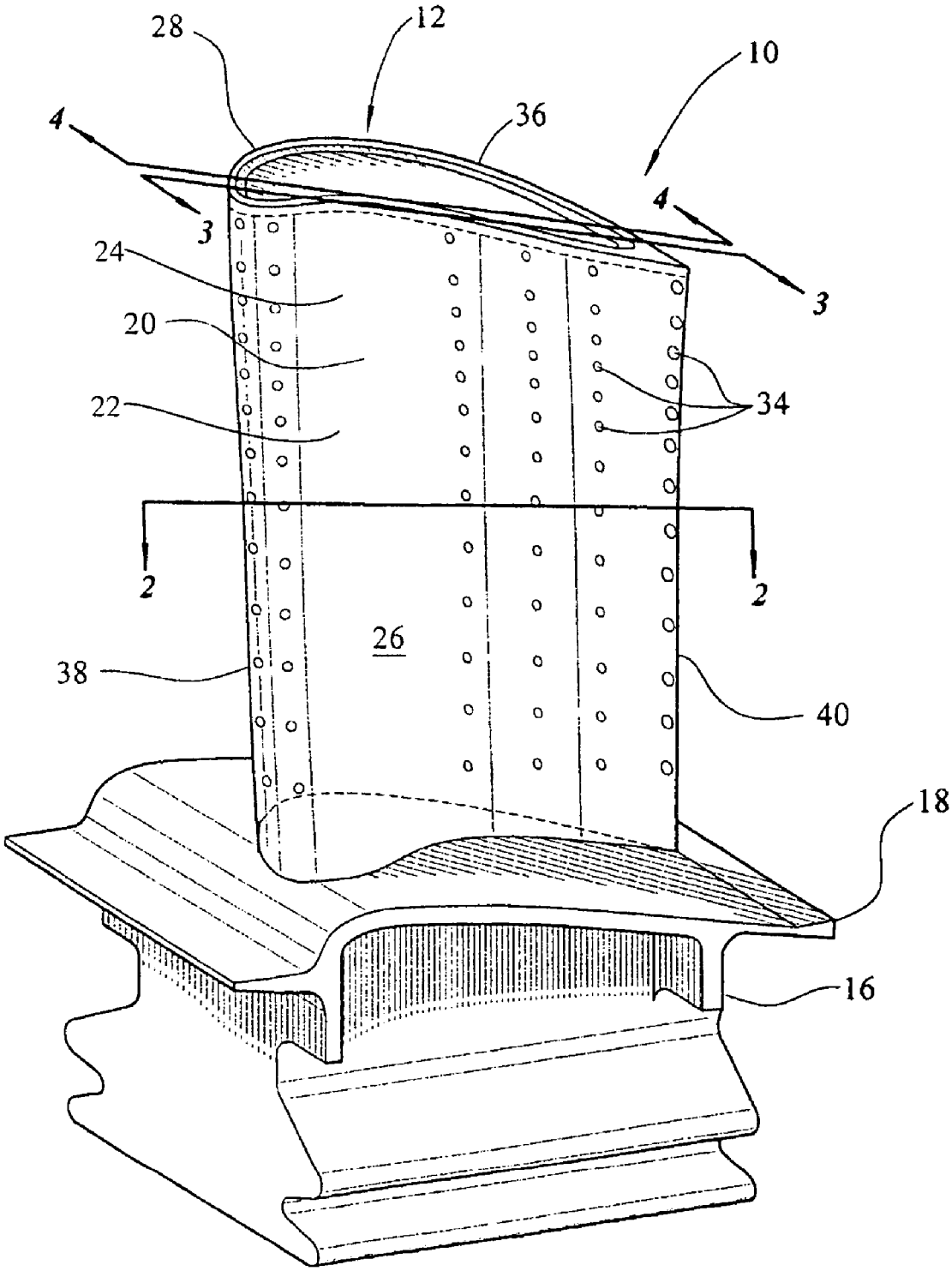
FIG. 1 is a perspective view of a turbine blade containing a cooling system of this invention.
Figure 2:
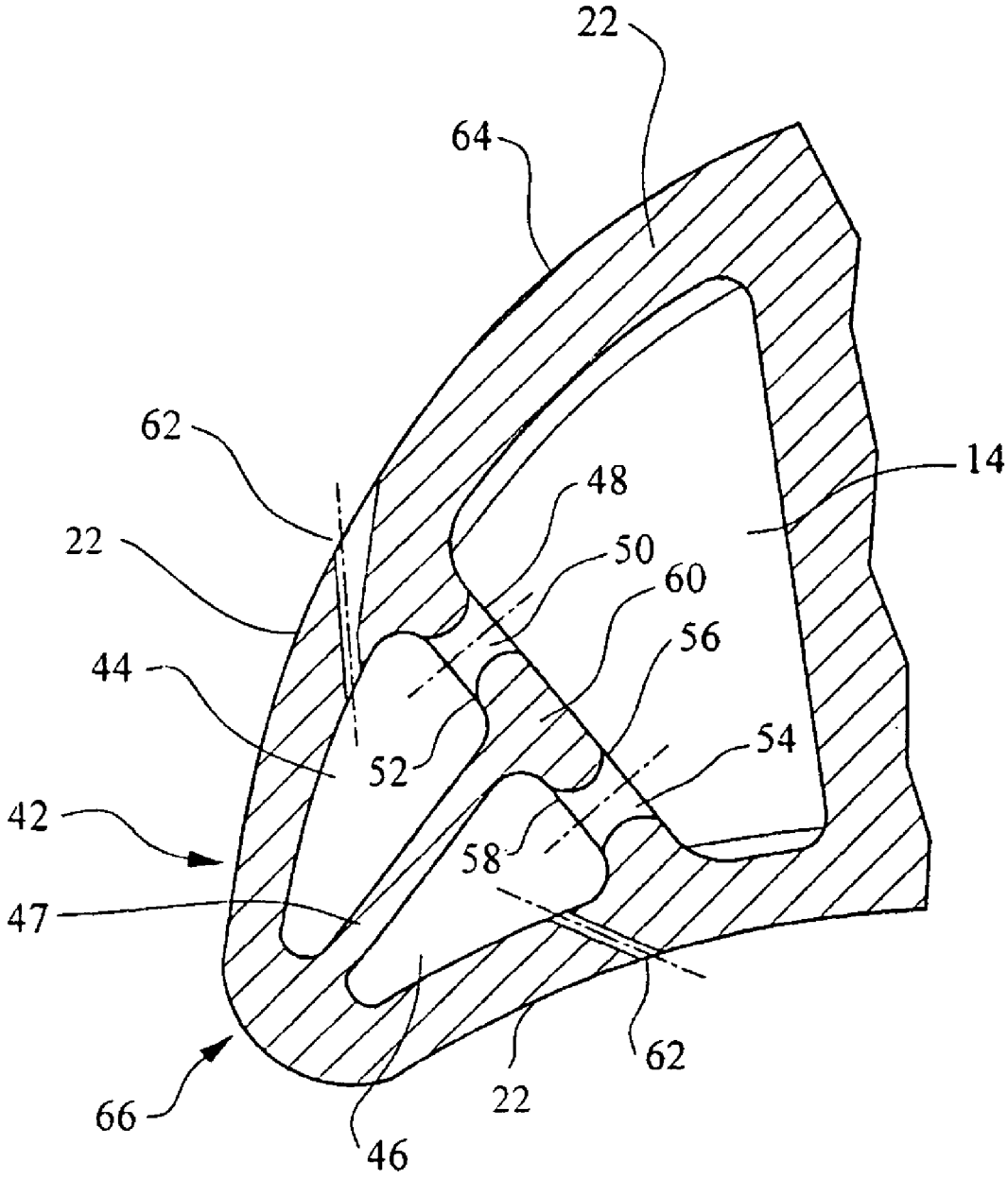
FIG. 2 is a partial cross-sectional view of the leading edge cooling system of this invention taken along section line 2—2 in FIG. 1.
Figure 4:
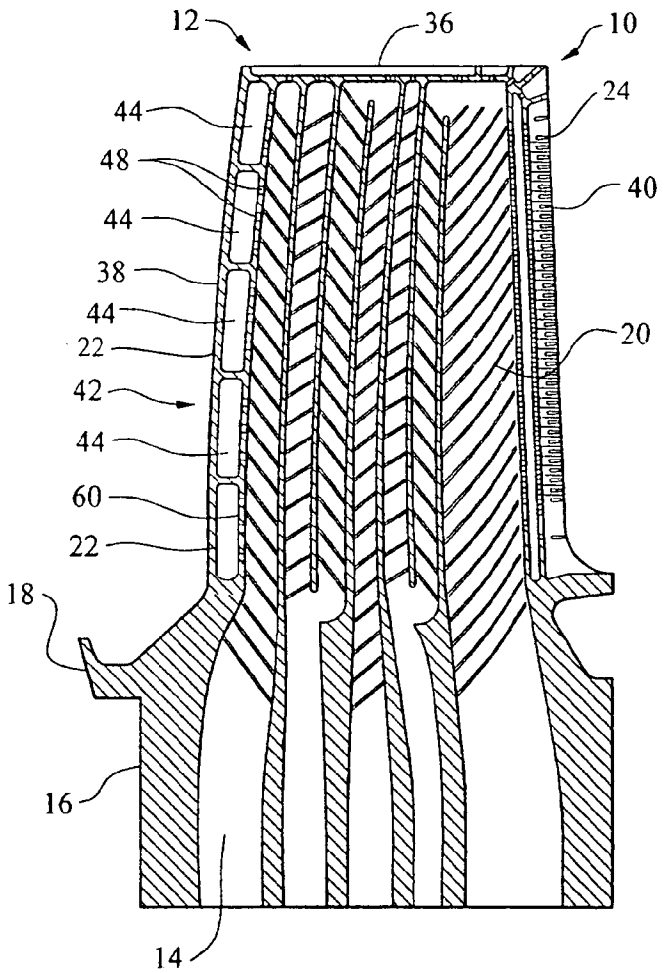
FIG. 4 is cross-sectional view of the turbine blade of FIG. 1 taken along section line 4—4 showing the suction side cooling channels.
Figure 3:
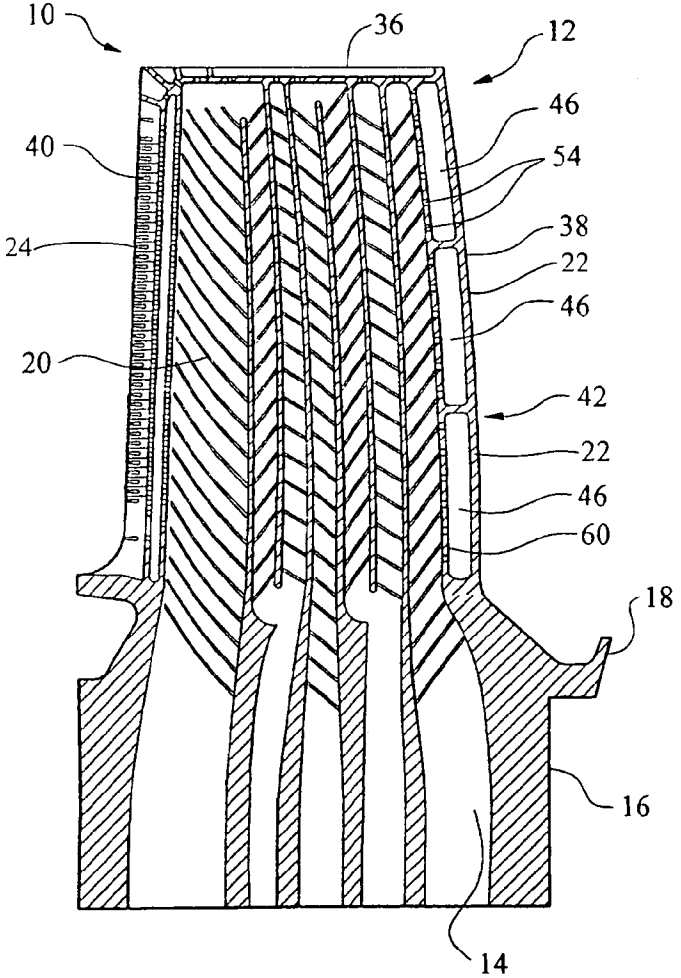
FIG. 3 is a cross-sectional view of the turbine blade of FIG. 1 taken along section line 3—3 showing the pressure side cooling channels.

As shown in FIGS. 1–5, this invention is directed to a turbine blade cooling system 10 for turbine blades 12 used in turbine engines. In particular, turbine blade cooling system 10 is directed to a cooling system 10 located in a cavity 14, as shown in FIGS. 3 and 4, positioned between outer walls 22. Outer walls 22 form a housing 24 of the turbine blade 12. As shown in FIG. 1, the turbine blade 12 may be formed from a root 16 having a platform 18 and a generally elongated blade 20 coupled to the root 16 at the platform 18. The turbine blade may also include a tip 36 generally opposite the root 16 and the platform 18. Blade 20 may have an outer wall 22 adapted for use, for example, in a first stage of an axial flow turbine engine. Outer wall 22 may have a generally concave shaped portion forming pressure side 26 and may have a generally convex shaped portion forming suction side 28.

The cavity 14, as shown in FIGS. 3 and 4, may be positioned in inner aspects of the blade 20 for directing one or more gases, which may include air received from a compressor (not shown), through the blade 20 and out one or more orifices 34 in the blade 20. As shown in FIGS. 3 and 4, the orifices 34 may be positioned in a leading edge 38, a trailing edge 40, the pressure side 26, and the suction side 28 to provide film cooling. The orifices 34 provide a pathway from the cavity 14 through the outer wall 22.

As shown in FIG. 2, the cavity 14 forming the cooling system 10 may include one or more leading edge cooling cavities 42. The leading edge cooling cavity 42 may be formed from a suction side cooling channel 44 extending radially within the blade 20 and a pressure side cooling channel 46 extending radially within the blade 20. The suction and pressure side cooling channels 44, 46 may be separated by a rib 47. The suction and pressure side cooling channels 44, 46 may extend from the root 16 to the tip 36, or in other embodiments, may extend radially along only a portion of the leading edge 38. In at least one embodiment, as shown in FIG. 4, the suction side cooling channel 44 may be formed from a plurality of channels. For instance, the cooling system 10 may include, but is not limited to, five suction side cooling channels 44. The pressure side cooling channel 46 may also be formed from a plurality of channels. For instance, the cooling system 10 may include, but is not limited to, three pressure side cooling channels 46. The suction and pressure side cooling channels 44, 46 may be aligned radially along the leading edge 38. In alternative embodiments, the suction and pressure side cooling channels 44, 46 may be offset radially in the spanwise direction as shown in FIGS. 3 and 4. Offsetting the suction and pressure side cooling channels 44, 46 increases the ability of the channels 44, 46 to dissipate heat from the blade 20 to the cooling fluid flowing through the cooling system 10.

As shown in FIGS. 2–4, the cooling system 10 may include one or more impingement orifices 48 providing a fluid pathway between the suction side cooling channel 44 and other portions of the cooling system 10. The impingement orifice 48 may extend through a rib 60 separating the leading edge cooling cavity 42 from other aspects of the cavity 14. There may exist one impingement orifice or a plurality of impingement orifices along the length of the suction side cooling channel 44. The impingement orifice 44 may include a filleted inlet 50 and a filleted outlet 52. Similarly, the cooling system 10 may include one or more impingement orifices 54 providing a fluid pathway between the pressure side cooling channel 46 and other portions of the cooling system 10. There may exist one impingement orifice or a plurality of impingement orifices 54 along the length of the pressure side cooling channel 46. The impingement orifice 54 may include a filleted inlet 56 and a filleted outlet 58.

Figure 5:
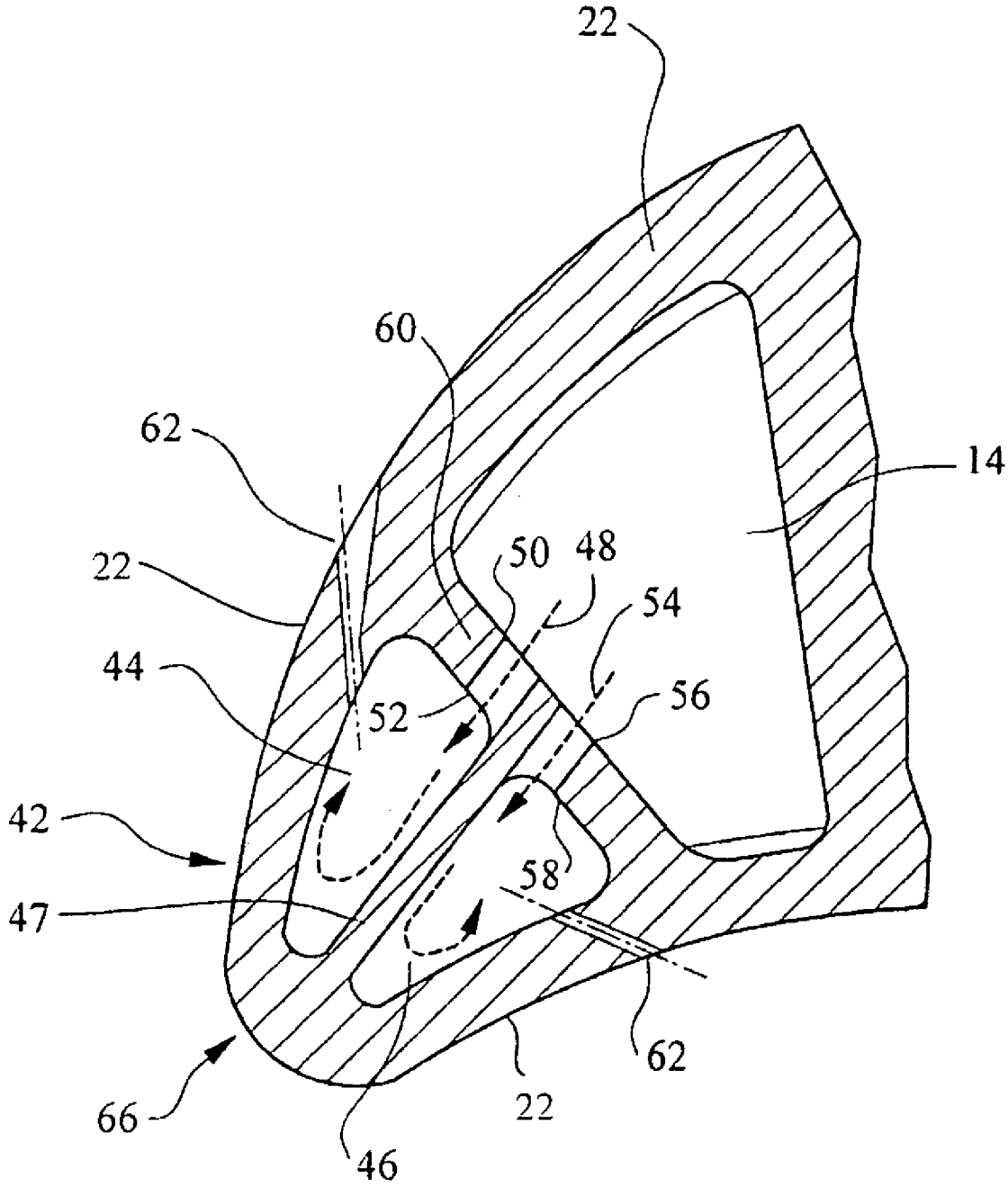
FIG. 5 is partial cross-sectional view of an alternative embodiment of the leading edge cooling channels taken along section line 2—2 in FIG. 1.

In at least one embodiment, as shown in FIG. 5, the impingement orifice 48 may be positioned such that the outlet 52 is in close proximity with the rib 47 and the fluid flowing through the impingement orifice 48 is directed to flow generally along the rib 47 and to form a vortex in the suction side cooling channel 44. Formation of the vortex may increase the ability of the impingement orifice 48 to remove heat from the blade 20, and more particularly, reduces the temperature of the outer wall 22 proximate to the stagnation point 66. Similarly, the impingement orifice 54 may be positioned such that the outlet 58 is in close proximity with the rib 47 and the fluid flowing through the impingement orifice 54 is directed to flow generally along the rib 47 and to form a vortex in the pressure side cooling channel 46.

The cooling system 10 may also include one or more gill holes 62 in the outer wall 22 providing a fluid pathway between the suction side cooling channel 44 and an outer surface 64 of the blade 20. The gill holes 62 may also provide a fluid pathway between the pressure side cooling channel 46 and the outer surface 64 of the blade 20. The gill hole 62 may be positioned such that the fluids exhausted from the suction side cooling channel 44 are not directed directly into the oncoming combustion gases. Rather, the gill holes 62 are positioned to exhaust cooling fluids from the cooling system 10 generally in the downstream direction of flow of the combustion gases past the blade 20.

During operation, cooling fluids enter the cooling system 10 through the root 16 as typically supplied from a compressor. The cooling fluids flow through various aspects of the cooling system and are exhausted through orifices 34. At least a portion of the cooling fluids is passed into the leading edge cooling cavity 42 through the impingement orifices 48 and 54. As the cooling fluids enter the suction and pressure side cooling channels 44, 46, the cooling fluids pass along the rib 47 and form vortices in the channels 44, 46. The fluids accept heat from the surface of the rib 47, rib 60, and the outer wall 22. The cooling fluids are exhausted through the gill holes 62 in the outer wall 22 and function as film cooling fluids on the outer surface 64 of the outer wall 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade, at least one cavity forming a cooling system in the blade, and an outer wall defining the at least one cavity forming the cooling system;

wherein the cooling system comprises a leading edge cooling channel formed from pressure side cooling channels extending radially within the elongated blade and suction side cooling channels extending radially within the elongated blade and separated from the pressure side cooling channels by a rib;

wherein the pressure side cooling channels each include at least one impingement orifice providing a fluid pathway between the pressure side cooling channels and other portions of the cooling system; and wherein the suction side cooling channels each include at least one impingement orifice providing a fluid pathway between the suction side cooling channels and other portions of the cooling system.

2. The turbine blade of claim 1, further comprising at least one gill hole in the outer wall providing a fluid pathway between at least one of the suction side cooling channels and an outer surface of the turbine blade and positioned to exhaust a cooling fluid in a general downstream direction.

3. The turbine blade of claim 1, further comprising at least one gill hole in the outer wall providing a fluid pathway between at least one of the pressure side cooling channels and an outer surface of the turbine blade and positioned to exhaust a cooling fluid in a general downstream direction.

4. The turbine blade of claim 1, wherein the at least one impingement orifice in the suction side cooling channels comprises a filleted inlet and a filleted outlet.

5. The turbine blade of claim 1, wherein the at least one impingement orifice in the pressure side cooling channels comprises a filleted inlet and a filleted outlet.

6. The turbine blade of claim 1, wherein the at least one impingement orifice in the pressure side cooling channels is positioned proximate to the rib separating the pressure side cooling channels from the suction side cooling channels to pass cooling fluids along the rib to form a vortex.

7. The turbine blade of claim 1, wherein the at least one impingement orifice in the suction side cooling channels is positioned proximate to the rib separating the pressure side cooling channels from the suction side cooling channel to pass cooling fluids along the rib to form a vortex.

8. The turbine blade of claim 1, wherein the suction side cooling channels are offset from the pressure side cooling channels in a spanwise direction.

9. The turbine blade of claim 1, wherein there are five suction side cooling channels and three pressure side cooling channels.

10. The turbine blade of claim 1, wherein the at-least pressure side cooling channel channels comprise a plurality of channels aligned in a spanwise direction along the leading edge.

11. A turbine blade, comprising:

a generally elongated blade having a leading edge, a trailing edge, and a tip at a first end, a root coupled to the blade at an end generally opposite the first end for supporting the blade, at least one cavity forming a cooling system in the blade, and an outer wall defining the at least one cavity forming the cooling system;

wherein the cooling system comprises a leading edge cooling channel formed from a plurality of pressure side cooling channels extending radially within the elongated blade and a plurality of suction side cooling channels extending radially within the elongated blade, offset spanwise relative to the pressure side cooling channels, and separated from the pressure side cooling channel by a rib;

wherein the pressure side cooling channels include at least one impingement orifice providing a fluid pathway between the pressure side cooling channels and other portions of the cooling system; and wherein the suction side cooling channels include at least one impingement orifice providing a fluid pathway between the suction side cooling channels and other portions of the cooling system.

12. The turbine blade of claim 11, further comprising at least one gill hole in the outer wall providing a fluid pathway between at least one of the suction side cooling channels and an outer surface of the turbine blade.

13. The turbine blade of claim 12, further comprising at least one gill hole in the outer wall providing a fluid pathway between at least one of the pressure side cooling channels and an outer surface of the turbine blade, wherein the gill holes in the suction side cooling channels and the pressure side cooling channels are positioned to exhaust a cooling fluid in a general downstream direction.

14. The turbine blade of claim 11, wherein the at least one impingement orifice in the suction side cooling channels comprise a filleted inlet and a filleted outlet.

15. The turbine blade of claim 11, wherein the at least one impingement orifice in the pressure side cooling channels comprise a filleted inlet and a filleted outlet.

16. The turbine blade of claim 11, wherein the at least one impingement orifice in the pressure side cooling channel is positioned proximate to the rib separating the pressure side cooling channel from the suction side cooling channel to pass cooling fluids along the rib to form a vortex, and the at least one impingement orifice in the suction side cooling channel is positioned proximate to the rib separating the pressure side cooling channel from the suction side cooling channel to pass cooling fluids along the rib to form a vortex.

17. The turbine blade of claim 11, wherein there are five suction side cooling channels and three pressure side cooling channels.

* * * * *